United States Patent [19]

Carle et al.

[11] 4,305,252

[45] Dec. 15, 1981

[54] CENTERING AND COOLING EQUIPMENT FOR A HYDRAULIC VIBRATION GENERATOR

[75] Inventors: Udo Carlé, Höhr-Grenzhausen; Gülertan Vural, Emmelshausen, both of Fed. Rep. of Germany

[73] Assignee: Koehring GmbH - Bomag Division, Boppard, Fed. Rep. of Germany

[21] Appl. No.: 57,265

[22] Filed: Jul. 12, 1979

[30] Foreign Application Priority Data

Jul. 19, 1978 [DE] Fed. Rep. of Germany ..... 2831793
Oct. 17, 1978 [DE] Fed. Rep. of Germany ..... 2845188

[51] Int. Cl.[3] ..... F15B 7/00

[52] U.S. Cl. ..... 60/571; 60/572; 60/594; 91/401

[58] Field of Search ..... 60/594, 572, 573, 539, 60/546, 571, 543, 378, 456; 91/401

[56] References Cited

U.S. PATENT DOCUMENTS

| | | | |
|---|---|---|---|
| 1,879,598 | 9/1932 | Bragg | 91/401 |
| 2,410,001 | 10/1946 | Ashbaugh | 91/401 |
| 2,784,704 | 3/1957 | Meats | 91/401 |
| 2,882,685 | 4/1959 | Carlsen | 60/543 |
| 3,058,450 | 10/1962 | Lissau | 91/401 |
| 3,242,675 | 3/1966 | Norton | 60/543 |
| 4,187,762 | 2/1980 | Buzby | 60/594 |

FOREIGN PATENT DOCUMENTS

| | | |
|---|---|---|
| 1634556 | 10/1971 | Fed. Rep. of Germany . |
| 2607190 | 8/1977 | Fed. Rep. of Germany . |
| 2732934 | 1/1979 | Fed. Rep. of Germany . |

*Primary Examiner*—Abraham Hershkovitz
*Attorney, Agent, or Firm*—Spencer & Kaye

[57] ABSTRACT

Centering and cooling equipment for a hydraulic vibration generator, with a pulsation generator pressurizing a cylinder containing a movable piston, composed of a feed system and a flushing system. The feed system includes spring-loaded non-return valves connecting a fluid reservoir to feed pipes connecting the pulsation generator to the cylinder chambers, and operates to supply cool pressure fluid from the reservoir when pressure in the cylinder chambers falls below a predetermined level. The flushing system includes a control bush/control plunger unit, bush and plunger of which are respectively connected to the piston and cylinder or vice versa, the plunger cooperating with channels in the bush to connect either feed pipe to a return passage according to the off-center position of the plunger in the bush. This system operates to withdraw a quantity of pressure fluid, dependent on pressure and stroke, from the cylinder chambers with each piston stroke.

16 Claims, 16 Drawing Figures

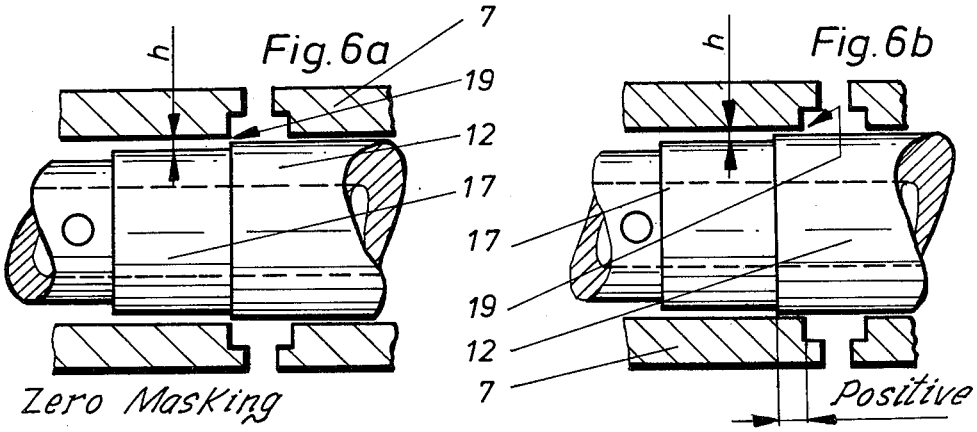
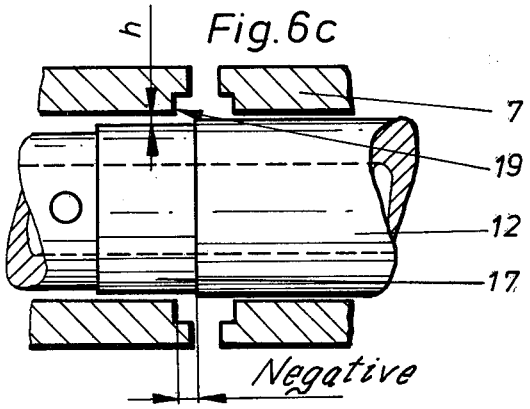
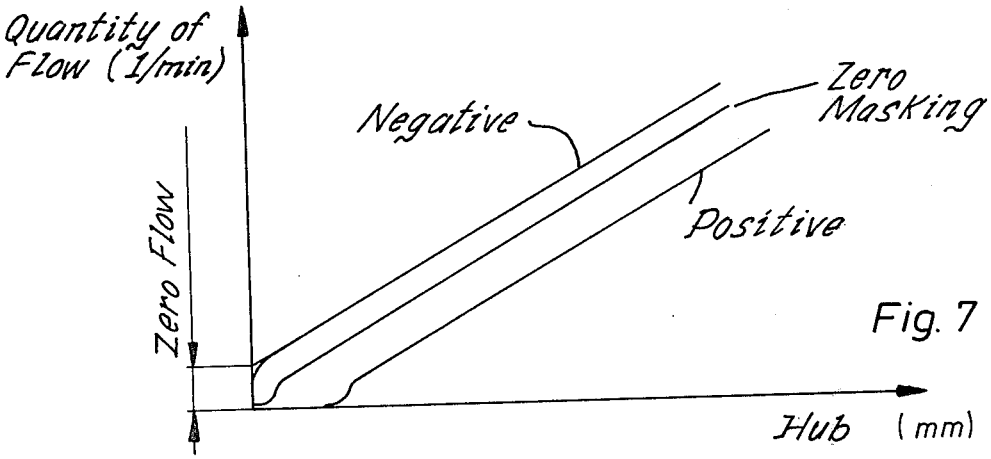
Fig. 7

Fig. 8a
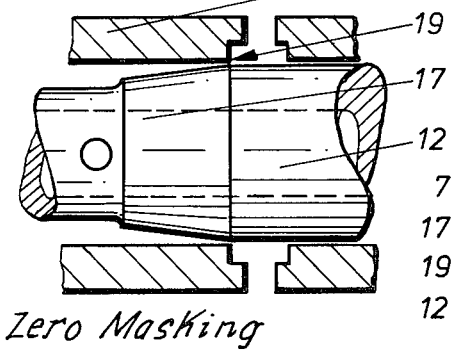
Fig. 8b
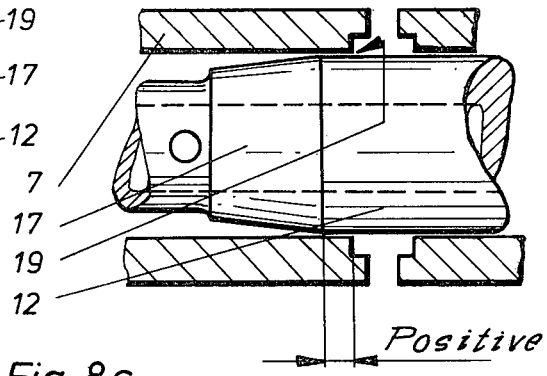
Fig. 8c
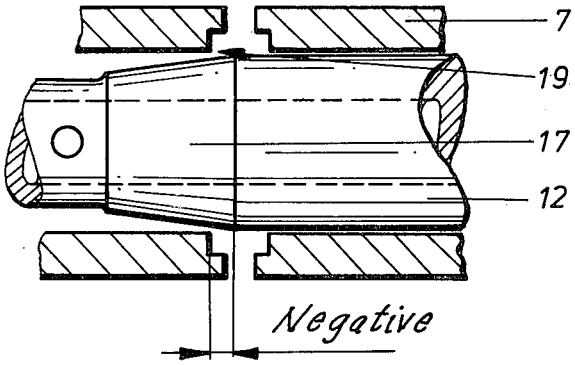
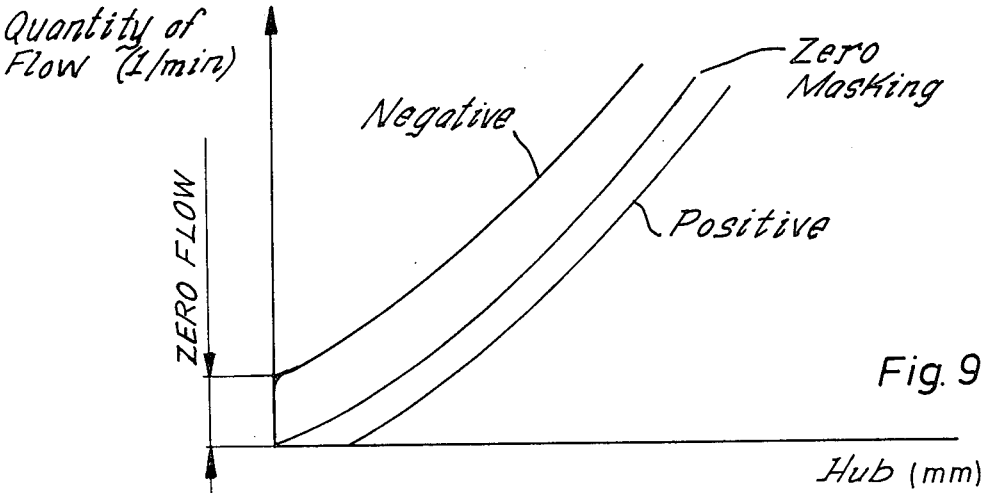
Fig. 9

CENTERING AND COOLING EQUIPMENT FOR A HYDRAULIC VIBRATION GENERATOR

BACKGROUND OF THE INVENTION

1. Field of the Invention

The invention relates to centering and cooling equipment for a hydraulic vibration generator with a pulsation generator pressurising a cylinder containing a movable piston, heated pressure fluid being extracted from each cylinder chamber and cool pressure fluid fed to it.

2. Description of the Prior Art

Such a hydraulic vibration generator is mainly used for driving vibratory compactors, but also for ramming and pulling machines used in construction work, for vibratory sieves, conveyors and stone breaking tools.

With these the piston can reciprocate in the cylinder or as an alternative the cylinder can reciprocate on the piston. These two methods are used for linear reciprocating motors.

Where the vibration generator is in the form of an angularly-oscillatory motor the oscillatable piston is rotated to and fro in a cylinder about an axis running in the lengthwise direction.

German OS No. 2 231 106 covers a vibration generator in which the phase difference between two pressure sources can be varied, thus allowing stepless adjustment of the cylinder/piston stroke and hence of the output.

With such a vibration generator and particularly at high vibration speeds and outputs, friction between the piston and the cylinder and also continuous contraction and expansion of the fluid under pressure generates a considerable amount of heat which is not dissipated via the pressure fluid itself since there is only a pulsating movement, i.e. a reciprocating movement, of the pressure fluid between the piston and the pressure source. However, heating of the fluid under pressure has an adverse effect on the lubrication characteristics between the sliding surfaces so that due to leakages fluid under pressure escapes and divergence of the piston results. Apart from this damage to the seals can result.

Control of the temperature of the pressure fluid in the cylinder can only be achieved by additional constructional features, for example by means of a heat exchanger round the cylinder, since in most cases sufficient heat dissipation by convection with the surrounding medium and radiation to adjacent components at lower temperatures does not occur.

These considerations particularly apply to vibration generators used for compaction of bituminous material in road construction as they are often subjected to temperatures of more than 100 degrees Centigrade.

Although the pressure source is separately mounted and thus spaced apart from the actual working cylinder, and hence works at normal temperatures, the operating temperatures in the working cylinder can reach an unbearably high level in the cases quoted above without any compensation taking place.

Thus German OS No. 2 607 190 covers a cooling system for a vibration generator in which the pressure fluid heated in the cylinder chambers is withdrawn and cool pressure fluid is fed to them.

However, a disadvantage is that the flushing out of the heated pressure fluid can only be dependent on pressure, i.e. the flushing quantity is always the same although with a constant pressure and small strokes less heat is generated than with long strokes. Thus with short strokes this design operates with uneconomically high flushing quantities. Metering of the necessary flushing quantity dependent on the stroke can only be achieved by relatively complicated methods since for this an additional external control mechanism with two sleeves is necessary.

For the periodic alternating pressurisation of the two cylinder chambers there are basically two further solutions available, one being the use of an electro-hydraulic control valve as for example covered by German OS No. 1 634 556 and also by the previous German Patent Application No. P 27 32 934.6 of the applicant, or also the SIREX "Impulse Generator" type of cylinder control, which converts a continuous supply of pressure fluid fed to it into one or two pulsating currents, so that the piston faces of cylinders connected to these currents can be pressurised on both sides.

In all cases however three basic troubles occur with the cylinder/piston drive unit which cause deviation of the oscillating piston in the cylinder after a short period of operation unless suitable counter measures are taken. These troubles are:

(a) internal and external leaks;

(b) asymmetry of the mass relationships, the effect of gravity and that of external forces on all the components fixed to the parts oscillating in relation no each other, i.e. the piston and cylinder; and (c) with the above uses the external effort to be applied is only delivered in one direction, likewise causing asymmetry and thus a tendency to deviation by the oscillating piston.

Troubles (b) and (c) lead to an unsymmetrical pressure pattern on the cylinder piston faces. Since the flow quantity depends on pressure, both with electro-hydraulic servo valves with flow regulation characteristics and also with the SIREX Impulse Generator as mentioned above with a set opening cross-section, there result from the operating conditions of the servo valve or the impulse generator in conjunction with the internal and external leaks a rapid deviation of the piston from the precise oscillation centre and unsymmetrical oscillation amplitudes per cycle.

To avoid this inevitable deviation of the piston a centring action must be carried out. Up to now this has been done by detecting movement of the piston by a stroke detector and regulating by feedback and the comparison of desired and actual values to bring the piston back to the desired oscillation centre and amplitude.

Thus with the ramming device covered by German OS No. 1 634 556 with a linear generator an electrical stroke detector is used to determine the actual stroke, the value of which is compared with the desired value in the control circuit. Dependent on results of the comparison a correction operation is applied to the electro-hydraulic control valve to adjust the desired stroke of the machine.

Also with the rammed material driving process covered by the previous German OS No. 27 32 934.6 a signal emitter is used as the stroke detector to carry out the centring operation.

To sum up, it can be seen that with vibration generators hitherto used and of the type described the movement of the piston is monitored by means of an electrical, inductive, capacitive or potentiometer-type stroke detector and is controlled by feedback.

A disadvantage with the centring devices based on an adjustment system is that the components of the electrical adjusting circuit are relatively complicated and thus relatively costly, thus having a considerable effect on the price of such a vibration generator. Apart from this stroke detectors hitherto used are very liable to break downs so that particularly under heavy duty conditions, as for example occur in a machine used for stone breaking, they are frequently damaged and fail to work. In addition to this, at the place of use of such machines dust can have a serious effect on the proper operation of such a detector so that corresponding and expensive measures must be taken to seal it off.

SUMMARY OF THE INVENTION

The object of the invention is therefore to produce centring and cooling equipment of the type described in which the disadvantages mentioned above do not occur.

It particularly relates to a cooling equipment which is simple to construct, which guarantees proper centring of the piston without any adjustment, i.e. without detection of actual value and feedback, with each stroke and which reliably prevents deviation of the piston in the cylinder as the result of leaks.

The invention achieves this by means of a feed system supplying pressure fluid when the pressure in the cylinder chambers falls below a predetermined level and a flushing system which with each stroke of the piston withdraws a quantity of pressure fluid dependent on pressure and stroke from the cylinders.

The advantages achieved by the invention are particularly based on the fact that at a precisely defined point in time in the stroke of the piston and cylinder a precise quantity of pressure fluid dependent on pressure and stroke can emerge from the cylinder, being immediately replaced by a corresponding quantity of cool pressure fluid on the other side. The quantity of fluid discharged can be such that a precisely defined temperature obtains at all times in the cylinder. This can for example be a temperature substantially equal to that of the pressure source or the reservoir tank for the pressure fluid.

This quantity of fluid is small in comparison with the working volume of fluid so that it can be discharged or delivered without much difficulty.

Since with greater displacement of the piston centre towards one side the dependence on stroke causes greater flushing on the opposite side, the deviation of the piston mentioned above rapidly stops, i.e. it is stabilised by the self-adjusting asymmetry of the flushing.

In preferred embodiments the flushing system is formed by a control bush/control plunger unit, bush and plunger being movable in relation to each other. When they are in a set position in relation to each other bores and annular passages are freed to allow the pressure fluid to escape from the appropriate cylinder chamber. Thus the flushing characteristic can be determined by selection of the position and shape of the annular gap occurring between the bush and the plunger.

The periodically alternating pressurisation of the two cylinder chambers can be effected either by an electro-hydraulic servo valve or by an impulse generator. In both these cases the quantity of hydraulic fluid fed to the cylinder chambers also includes the quantity replacing that flushed out in the preceding cycle. Nor in these two cases is a stroke detector and the necessary adjustment to a desired value necessary with the design in accordance with the invention but on the other hand centring of the piston is automatic, i.e. without external measures. In addition the load pressure dependence occurring with a servo valve and impulse generator is here stabilised.

Other features of the invention will be apparent from the following description, drawings and claims, the scope of the invention not being limited to the drawings themselves as they are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

BRIEF DESCRIPTION OF THE DRAWINGS

FIGS. 6*a*, 6*b* and 6*c* are detail views showing various overlap possibilities with an annular gap of constant width.

FIG. 7 is a performance diagram showing the flushing characteristics for the various amounts of overlap represented in FIGS. 6.

FIGS. 8*a*, 8*b*, and 8*c* are detail views showing various overlap possibilities with an annular gap of varying width.

FIG. 9 is a performance diagram showing the flushing characteristics for the various amounts of overlap represented in FIGS. 8.

DESCRIPTION OF THE PREFERRED EMBODIMENTS

Figure 1:
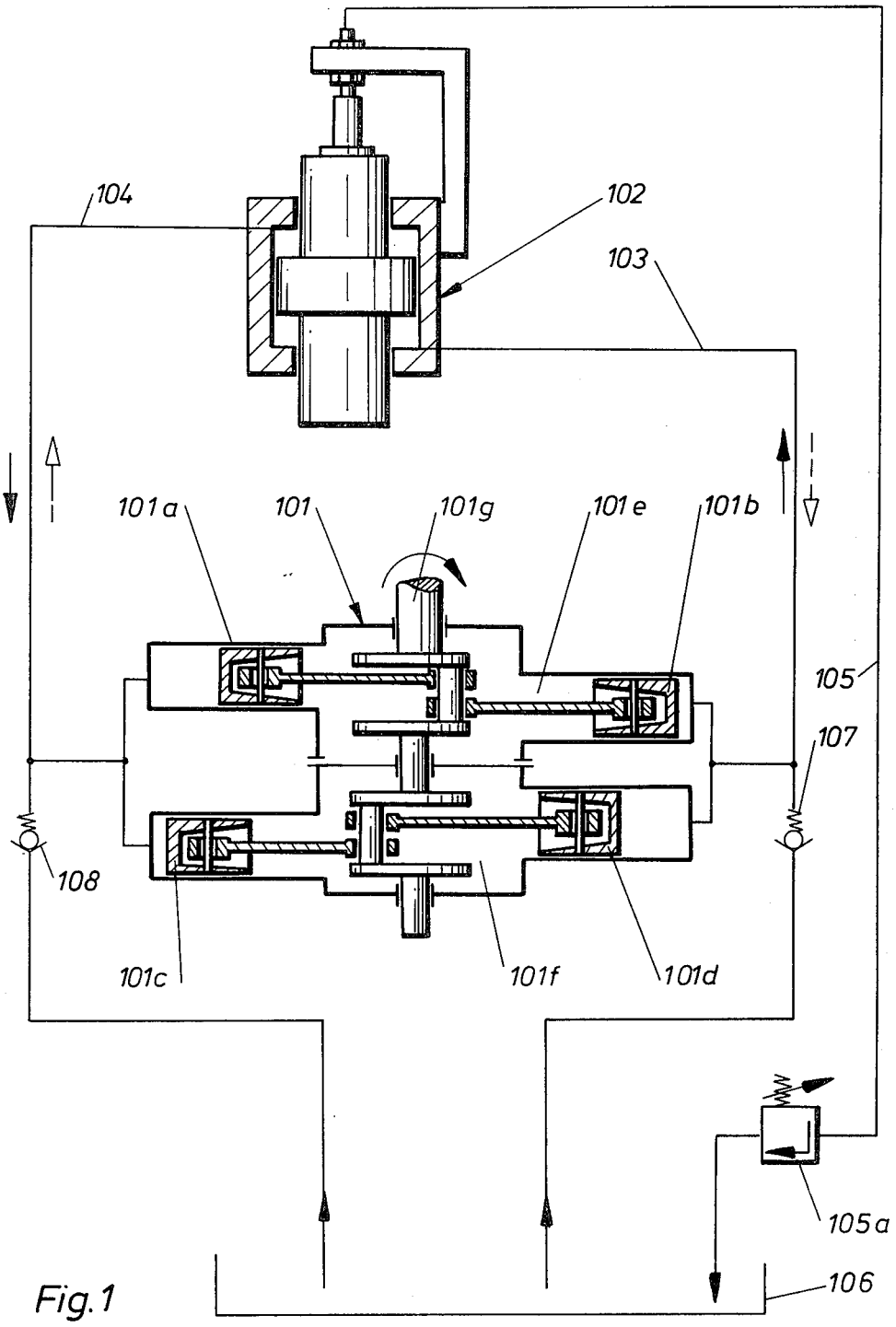
FIG. 1 is a partly cross-sectional, schematic view of a feed system for cooling equipment in accordance with the invention in conjunction with a conventional vibration generator.

FIG. 1 shows a design of a feed system for cooling equipment in accordance with the invention for the working cylinder of a hydraulic vibration generator.

The working circuit consists of a pulsation generator 101 composed of pairs of pistons 101*a*, 101*b* and 101*c*, 101*d* accommodated in cylinder housing halves 101*e* and 101*f* and driven by a crankshaft 101*g*. By alteration of the phase relationship of the two paris of pistons relative to each other the quantity of fluid delivered and thus the piston stroke of a working cylinder 102, i.e. its output, can be separately adjusted between zero and a maximum value. The alteration of the phase relationship is typically effected by turning the housing halves 101*e* and 101*f* in relation to each other.

Such a hydraulic vibration generator is covered by German No. 2 231 106, so that it need not be further described here.

The working cylinder 102 has in FIG. 1 a cylinder, shown only schematically, in which a piston moves in the lengthwise direction. Construction and operation of the cylinder 102 will be further explained below. The two unions of the pulsation generator 101 are connected by pipes 103 and 104 with the cylinder chambers on opposite sides of the piston in the working cylinder. The flow direction in the two pipes 103 and 104 is shown by the arrows.

A discharge passage 105 for the oil flushed out of the working cylinder 102 forms the connection to a reservoir tank 106. A preloading valve 105*a* in the discharge passage 105 allows a predetermined back pressure to be set and by this the quantity flushed out can also be affected.

The flushing system of the working cylinder 102 is described in greater detail below.

The reservoir tank 106 is also connected by spring-loaded non-return valves 107 and 108 to the feed pipes 103 and 104 respectively. These non-return valves 107 and 108 operate under load depression in the feed pipes 103 and 104 and feed fluid from the tank into the respective pipes.

When drying hydrostatic coupling between the pulsation generator 101 and the working cylinder 102 a set amount of pressure fluid is discharged from the cylinder chamber on one side of the piston via the discharge passage 105, the pressure in the feed pipe 103 or 104 to the opposite cylinder chamber falls so that when this drops below a threshold value the corresponding non-return valve 107 or 108 operates and feeds pressure fluid from the reservoir tank 106 into the pipe. This operation takes place once per revolution of the crankshaft 101*g* of the pulsation generator on each side of the piston.

Figure 2:
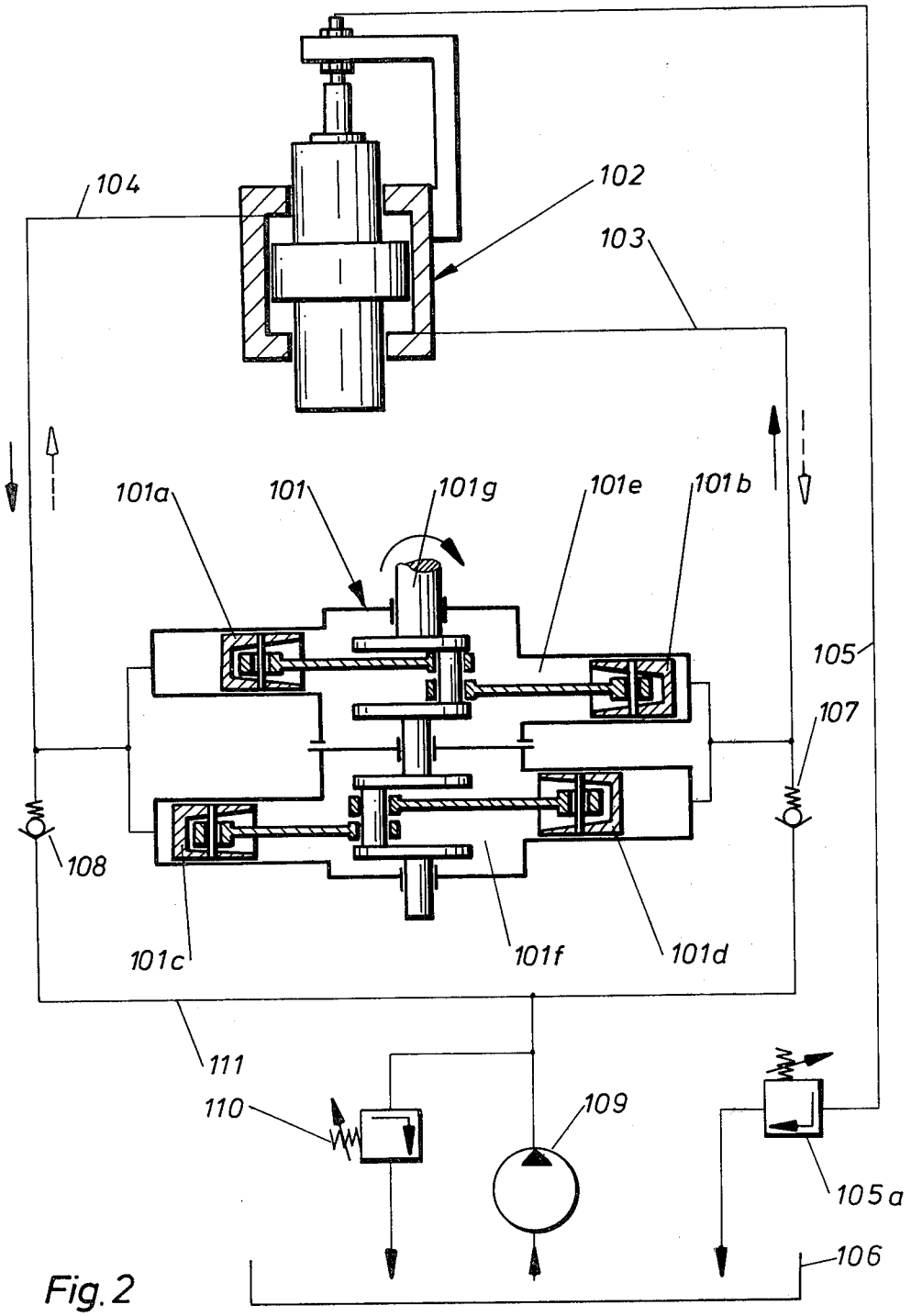
FIG. 2 is a view similar to that of FIG. 1 of a modification in the design of the feed system of FIG. 1.

In FIG. 2 a further design of a feed system for the working cylinder of a hydraulic vibration generator is shown and which differs from the design in FIG. 1 in that in the feed pipe 111 from the reservoir tank 106 to the spring-loaded non-return valves 107 and 108 a feed pump 109 is provided. By means of a pressure limiting valve 110 pressure in the feed pipes 103 and 104 can be set to a particular level.

Apart from this this design is similarly constructed and operates in a similar manner to that in FIG. 1 so there is no need to give any further description of the corresponding components and their method of operation.

The feed pump 109 continuously generates at the spring-loaded non-return valves 107 and 108 a set fluid pressure so that when pressure falls below that set at the pressure limiting valve 110 in the pipes 103 and 104 fresh fluid is delivered from the reservoir tank 106 into the feed pipes 103 and 104.

Which of the feed systems described here is selected for a working cylinder depends on the overall constructional circumstances and the demands on the working cylinder.

Figure 3:
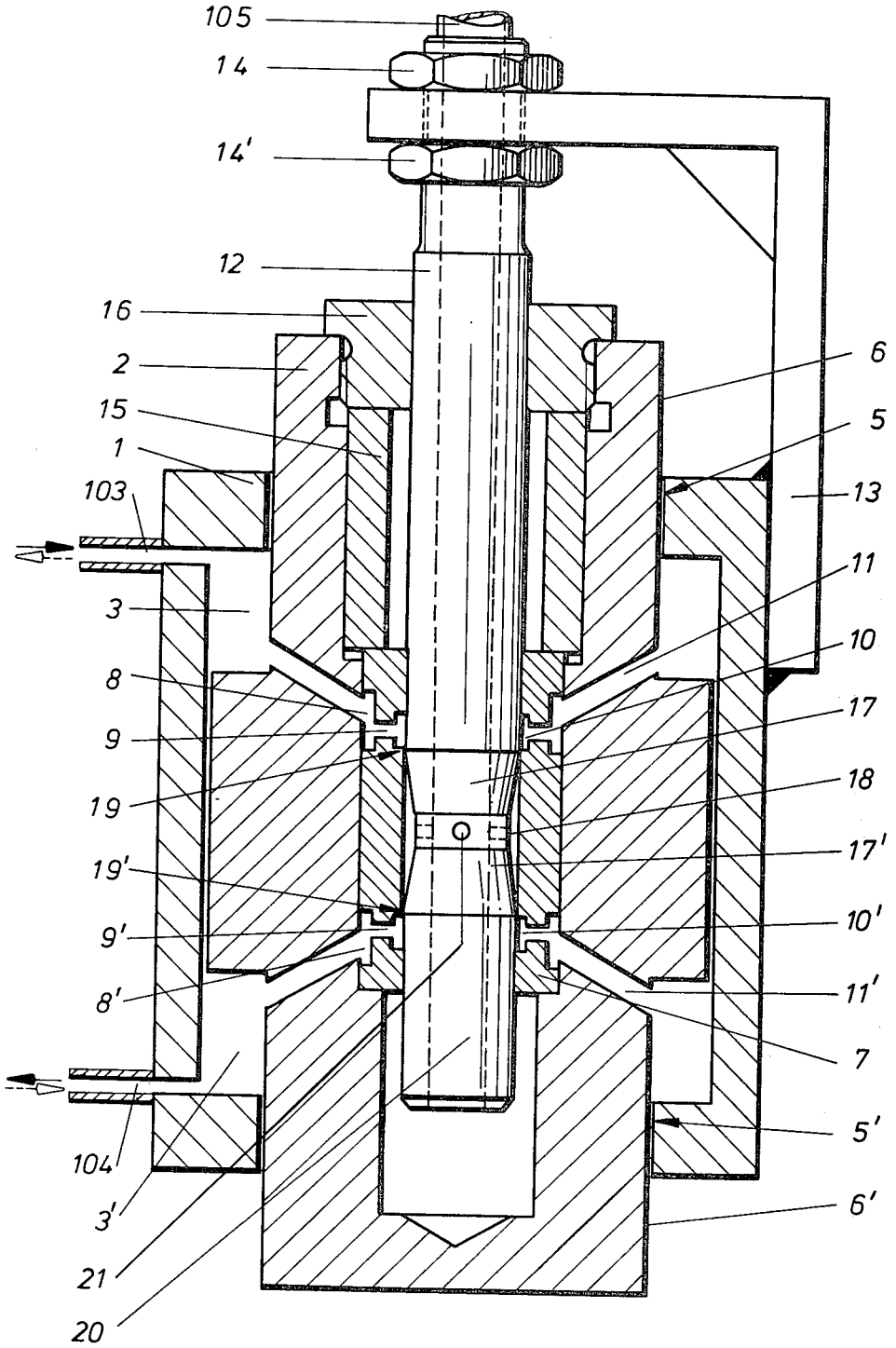
FIG. 3 is a cross-sectional, detail view of an embodiment of a flushing system according to the invention in which the control bush/control plunger unit is accommodated inside the piston.

In FIG. 3 a flushing system is shown in the form of a control bush/control plunger unit for the working cylinder 102 of FIGS. 1 and 2 and accommodated inside the piston 2 of the cylinder 1. With this flushing system discharge of the fluid flushed out takes place via the hollow control plunger.

As already briefly indicated above such a working cylinder 102 has a cylinder 1 in which a piston 2 slides in the lengthwise direction. The upper cylinder chamber 3 shown in FIG. 3 is connected via the pipe 103 and the lower cylinder chamber 3' via the pipe 104 respectively to the pressure source shown in FIGS. 1 and 2 and which generates the necessary alternating fluid current for the oscillating movement of the piston 2. Stepless adjustment of the volume of this fluid current from the pressure source as covered by German AS No. 2 231 106 can vary the stroke of the piston 2 from zero to a peak value corresponding to the maximum fluid current.

The piston rods 6 and 6' of the piston 2 slide against the respective sealing surfaces 5 and 5' on the cylinder 1 so that at these points in general pressure fluid can escape from the cylinder 1. In practice these leaks at the sealing surfaces 5 and 5' are never equal and thus, in conjunction with further internal leaks between the piston 2 and the cylinder 1, can cause gradual deviation of the piston 2 from the initial position and in general from the central position in the cylinder 2.

In order to avoid this deviation of the piston 2 and simultaneously to exclude an undesirable temperature rise in the cylinder 1, a control bush/control plunger unit is disposed inside the piston 2 acting as a flushing system, working in conjunction with the feed system already explained with reference to FIGS. 1 and 2.

Inside the hollow piston 2 is a control bush 7 having in its outer periphery two annular channels 8 and 8'. The control bush is hollow and has annular channels 10 and 10' on the inside connected by bores 9 and 9' with the external channels 8 and 8'. Apart from this the external channels 8 and 8' are connected by bores 11 and 11' in the piston rods 6 and 6' of the piston 2 with the cylinder chambers 3 and 3'.

The control bush 7 is axially located in the piston rod 6 through a distance sleeve 15 by means of a cover 16. A control plunger 12 slides in the lengthwise direction inside the control bush 7 and is connected by a bracket 13 and adjusting nuts 14 and 14' to the outer wall of the cylinder 1.

The shank of the control plunger has, near the annular channels 10 and 10' of the bush 7, two tapered portions 17 and 17' facing towards each other and joined together via a groove 18. Towards the annular channels 10 and 10' the tapering portions 17 and 17' join on to the full diameter portion of the shank of the control plunger 12 and the edges 19 and 19' of the annular channels 10 and 10' adjacent each other act as control edges as will be explained further below.

The control plunger 12 has a through bore 20 in its lengthwise direction and at least one radial bore 21 at the groove 18.

The bore 20 is connected via the discharge passage 105 shown in FIGS. 1 and 2 with the reservoir tank 106, i.e. the discharge, to be described below, of the fluid flushed out takes place via the bore 20 and the discharge passage 105.

The operating principle of this design is as follows. When for example the cylinder chamber 3 is pressurised with fluid via pipe 103 the piston 2 moves as shown in FIG. 3 from the position shown in this figure, in which control edges 19 and 19' of the annular channels 10 and 10' are masked by the full diameter of the control plunger, from top to bottom. During this movement and as soon as control edge 19 is uncovered by the tapering portion 17, pressure fluid can flow out of the cylinder chamber 3 via bores 11 into the chamber between the bush 7 and the tapering portions 17 and 17' and the groove 18 and is then flushed out via the radial bore 21 and the lengthwise bore 20 in the control plunger 12.

With this movement the lower annular channel 10' is masked by the full shank diameter of the control plunger 12, so that no fluid can emerge through it.

Replacement of the quantity of fluid flushed out by a corresponding amount of fresh fluid takes place during the stroke now occurring on the discharge side of the piston 2 via the feed and suction system shown in FIGS. 1 and 2.

On the return movement of the piston 2, i.e. when the cylinder chamber 3' is pressurised with fluid and on passing through the initial position a corresponding flushing of the cylinder chamber 3' takes place, when a corresponding outlet gap is free between the control edge 19' and tapering portion 17'.

When the centre of the piston oscillation deviates due to different leakage at the sealing surfaces 5 and 5' there occur, due to the resulting alteration in position of the control plunger 12 in relation to the bush 7, different quantities of flushed out pressure fluid from the two cylinder chambers 3 and 3'. This results in stopping of the deviation of the oscillation centre and setting a stable central position.

Apart from this the central position of the piston stroke within the cylinder 1 can also be predetermined from outside by corresponding adjustment of the nuts 14 and 14' which slide the control plunger 12 in the lengthwise direction inside the piston 2.

As an alternative to this, this predetermination of the oscillation centre can be effected by electromechanical or hydraulically operated adjusting members.

Figure 4:
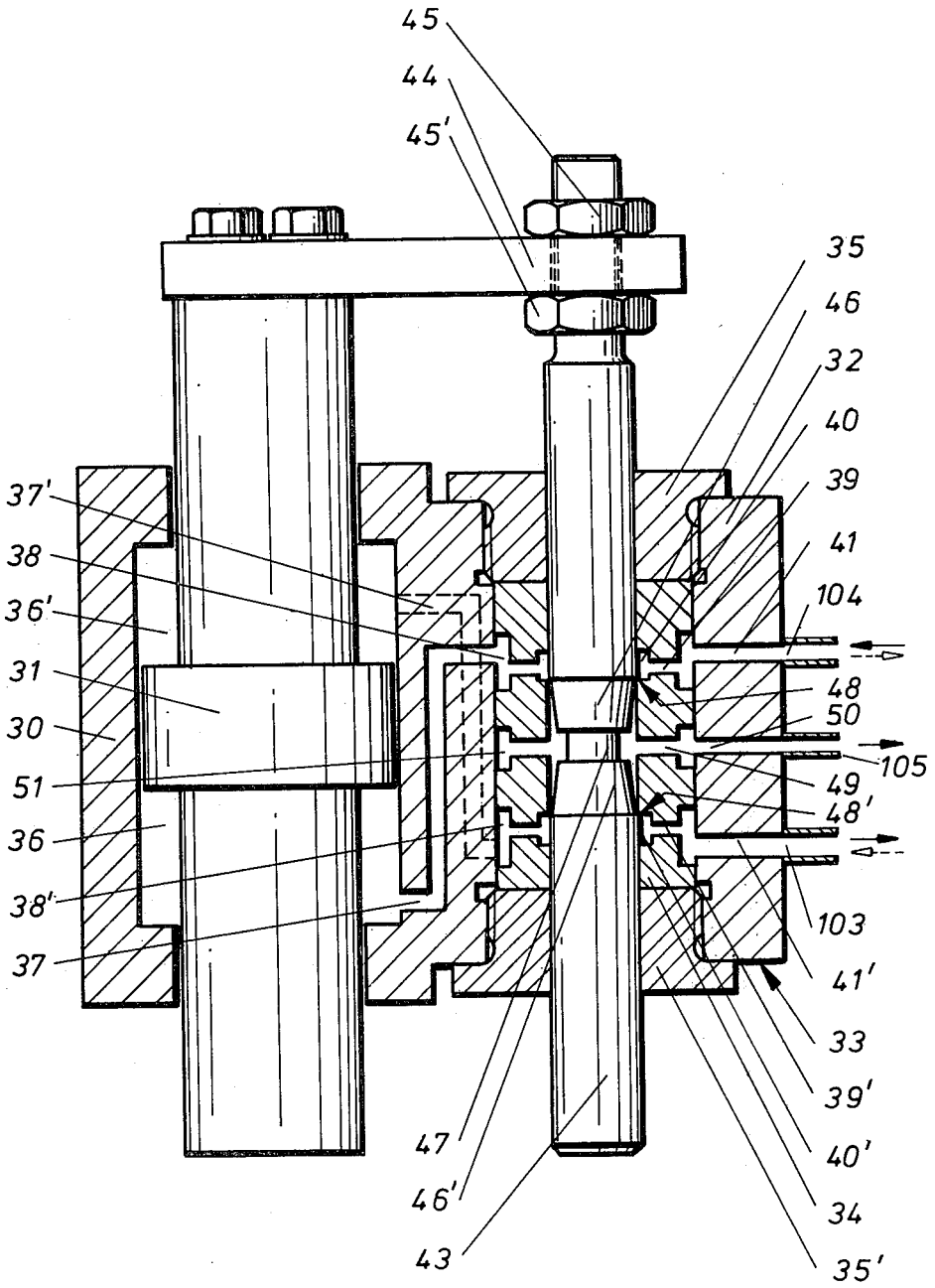
FIG. 4 is a view similar to that of FIG. 3 showing a modified flushing system in which the control bush/control plunger unit is mounted outside the cylinder.

In FIG. 4 a design of the flushing system is shown in which the control bush/control plunger unit is situated outside the working cylinder designated by 102 in FIGS. 1 and 2. In this case the supply of pressure fluid takes place via the housing of the control bush/control plunger unit, but as an alternative it can also take place at the cylinder 30 itself.

With this design a piston 31 is accommodated in a cylinder 30 so that it can slide in the lengthwise direction. A control bush/control plunger 33 is flange mounted on the side of the cylinder 30. Also with this design the control bush 34 is secured to the cylinder 30 by means of end covers 35 and 35'.

The other cylinder chamber 36' shown in FIG. 4 of the cylinder 30 is connected via a passage 37' in the cylinder 30, an annular channel 38' in the control bush 34, a bore 39' in the control bush 34, an annular channel 40' in the control bush 34 and a bore 41' in a housing wall 32 and the feed pipe 103 with the pressure source shown in FIGS. 1 and 2. Similarly the lower cylinder chamber 36 shown in FIG. 2 is connected via passages and bores 37 to 41 and the feed pipe 104 with the pressure source.

In the control bush 34 there is a control plunger 43 which slides in the lengthwise direction in the bush and which is secured by a bracket 44 and adjusting nuts 45 and 45' to the piston 31.

The control plunger 43 has, like the control plunger in the design described above, two tapering portions 46' and 46 on its shank near the channels 40 and 40' and connected together by a groove 47. In this design adjacent edges 48 and 48' of the annular channels 40 and 40' act as control edges.

With this design flushing of the pressure fluid takes place from the two cylinder chambers 36 and 36', on release of the respective control edge 48 or 48' by the tapering portion 46 or 46', via a bore 49 in the control bush 34, a bore 50 in the housing section 32 and the discharge passage 105.

Apart from this the design operates in the same manner as that shown in FIG. 3 so that it will not be described in further detail.

Figure 5:
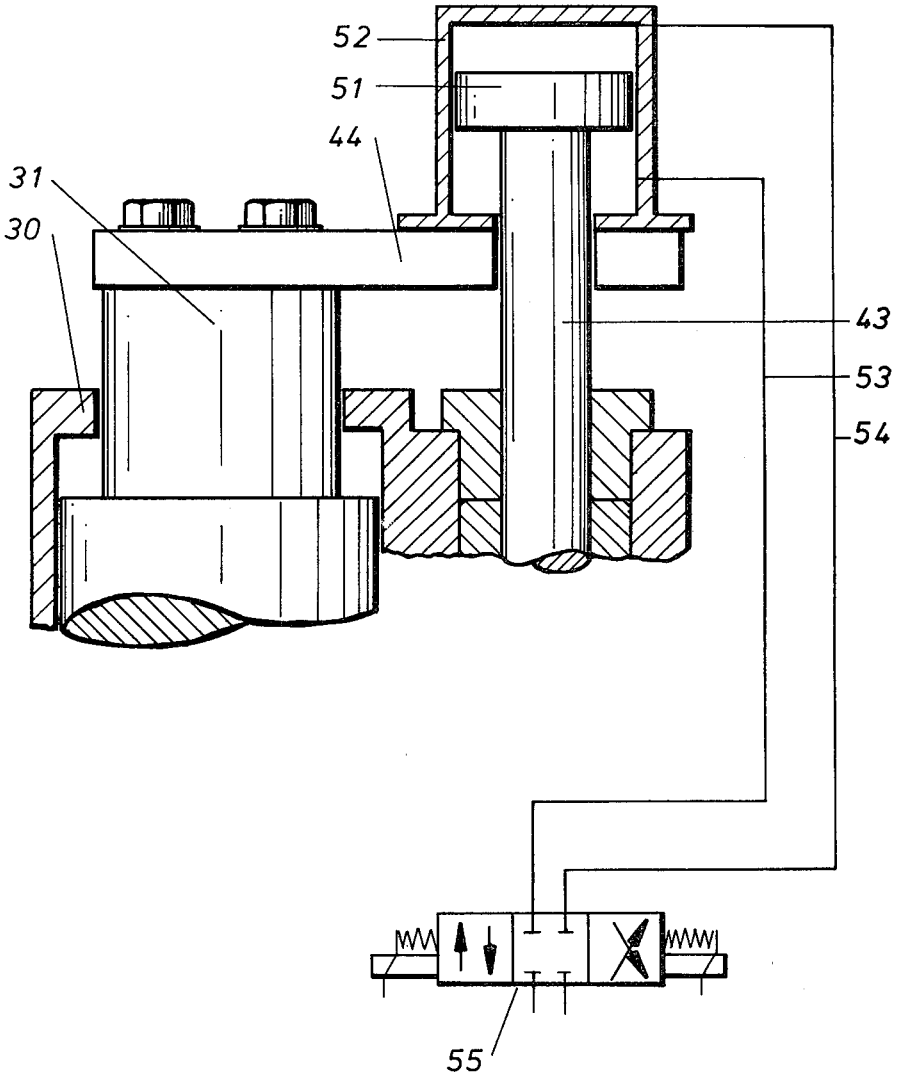
FIG. 5 is a cross-sectional detail view of a portion of a modified version of the flushing system of FIG. 4 in which an additional movement can be superimposed on the control plunger.

In FIG. 5 a modification of the design in FIG. 4 is shown in which the control plunger 43 itself is subjected to oscillating movement with a controlled stroke so that the plunger 31 carries out a separate movement superimposed on the basic oscillation.

With this modification the upper end of the control plunger 43 forms a piston 56 sliding in a hydraulic or pneumatic cylinder 52 in the lengthwise direction of the plunger 43. The cylinder 52 is connected by pipes 53 and 54 and a control valve 55 with a separate pressure source (not shown) and to the reservoir tank shown in FIGS. 1 and 2.

By pressurisation of the cylinder 52 there can be exerted on the piston 56 and thus on the control plunger 43 a periodic or non-periodic movement in relation to its mounting under the control of the valve 55. This allows the position of the oscillation centre of the piston 31 in the cylinder 30 to be adjusted. This is a useful feature in several applications.

This modification can of course also be incorporated in the design in accordance with FIG. 3.

As an alternative to this, adjustment of the control plunger 43 can be effected by a spindle and electric motor or a rack and pinion. An eccentric or cam drive could also be used.

The flushing characteristics, i.e. the varying amount of fluid flushed out during a stroke, depends on the shape of the tapering portions 17 and 17', or 46 and 46'. The possibilities of altering the flushing characteristic are described below.

With otherwise constant parameters and particularly constant pressure difference there flows through an annular gap a fluid quantity Q (liters/min), proportional to $h^3/L$. Therefore $$Q = Kh^3/L \text{ (liters/min)},$$

where K is a proportional constant, h the radial width of the annular gap and L the length of the annular gap.

FIGS. 6 show a design of the control bush/control plunger unit in which the tapering portions 17, 17', or 46,46' are in the form of a stepped gap 17 with a fixed cross-section. Thus with this design the width h of the annular gap 17 between the control bush and the control plunger is constant so that only its length can be used to affect the flushing characteristic.

Based on the different lengths of this annular gap the following three conditions can be defined, the illustrations referring to the symmetrical central position of the control edges and tapering portions to each other.

With so-called "zero masking" the step on the tapering portion 17 is exactly in line with the control edge 19. This state is shown in FIG. 6*a*.

With so-called "positive masking" the shank section of the control plunger 12 of maximum diameter extends for a certain distance beyond the control edges so that no fluid can flow out to either side. This state is shown in FIG. 6*b*.

With so-called "negative masking" and in the symmetrical position there is a certain annular gap at both control edges so that also in the central position of the piston there can be a certain quantity of fluid flushed out, the so-called "zero through flow". This state is shown in FIG. 6*c*.

In FIG. 7 the flow characteristics for these three conditions are shown and thus the quantity of fluid flowing out per unit of time in relation to the stroke of the piston in the working cylinder.

It can for example be seen that with negative masking there is always a certain amount of flushing out while with zero masking a situation results with a "zero" outflow. With positive masking finally the initial outflow of fluid takes place relatively late in comparison with the other two states.

With the aid of these characteristics based on theoretical considerations a desired flushing characteristic can be obtained by suitable choice of the amount of masking (positive or negative).

FIGS. 8 show a conical tapering portion 17, i.e. with increasing deflection from the central position and thus reduction of the length L of the annular gap the width of the annular gap continuously increases.

Zero, positive and negative masking for this type of tapering section are represented in FIGS. 8*a*, 8*b* and 8*c* respectively.

The flow characteristics for this design are shown in FIG. 9 from which can be seen that they are appreciably steeper than with an annular gap of constant width. Apart from this these flow curves can also be affected by the cone angle, being more or less steep depending on this angle. For a particular application, selection of a suitable width or length of the annular gap and thus the degree of masking and by use of a suitable cone angle an optimum flushing characteristic can be obtained. In addition it must be remembered that with small oscillation amplitudes of the piston less heat losses occur than with large amplitudes so that the flushing quantity in this range can be set to the optimum amount dependent on the oscillation amplitude.

If for example zero masking is used for small oscillation amplitudes the quantity flushed out near the central position can become too great in relation to the working quantity per half stroke (see also FIG. 7) since with zero masking the flushing operation starts immediately after leaving the oscillation centre. If this is the case positive masking should be used as with this the control plunger must first perform a "dead stroke" before flushing out through the passages can take place.

Figure 10:
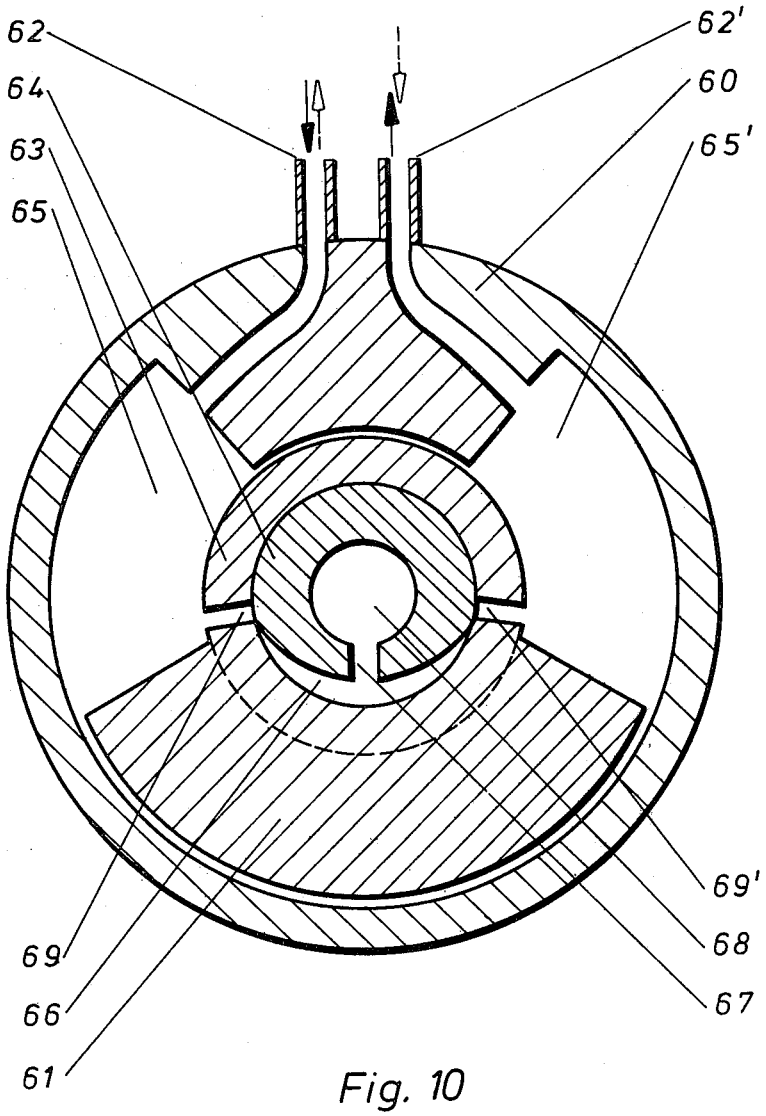
FIG. 10 is an axial, cross-sectional view of a flushing system for a vibration generator in the form of an angularly-oscillatory motor.

While with the designs described above the vibration generator is in the form of a linear stroke motor, FIG. 10 shows a vibration generator in the form of an angularly-oscillatory motor.

With this design an angularly-oscillatable piston 61 rotates in a housing 60, and forms, in the housing, chambers 65 and 65'. These chambers 65 and 65' can be connected by pipes 62, 62' with a supply of fluid under pressure from a pressure source as shown in FIGS. 1 and 2.

Inside a hollow shaft 63 integral with the angularly-oscillatable piston 61 is a control plunger 64 which is coupled to the housing 60 outside the chambers 65 and 65' by suitable connectors, which are not shown, so that it cannot rotate.

The control plunger 64 has over part of its periphery a slot 66, extending for a short distance in the axial direction; as can be seen from FIG. 10 the slot 66 extends for an angle of roughly 150 degrees around the periphery of the control plunger 64.

The slot 66 is connected via a radial bore 67 in the control plunger 64 with the hollow inner chamber 68 of the plunger 64. This inner chamber is further connected by a discharge passage which is not shown to the reservoir tank of the pressure source.

Finally in the annular area of the shaft 63 are further radial bores 69 and 69', which when in register therewith connect the slot 66 with the chambers 65 and 65'.

With each stroke of the angularly-oscillatable piston 61 with this design the bores 69 and 69' are uncovered by the slot 66 so that fluid under pressure can flow out from the chambers 65 and 65' through the bores 69 and 69' into the slot 66 and from there through the bore 67 and the discharge passage. The corresponding quantity of fluid is similarly replaced as in FIGS. 1 and 2 via the connections 62 and 62' from the pressure source.

With this design also suitable selection of the degree of control edge masking of the bores 69 and 69' and the slot 66, and of the shape of the slot 66, enables the desired flushing characteristics to be obtained.

Figure 11:
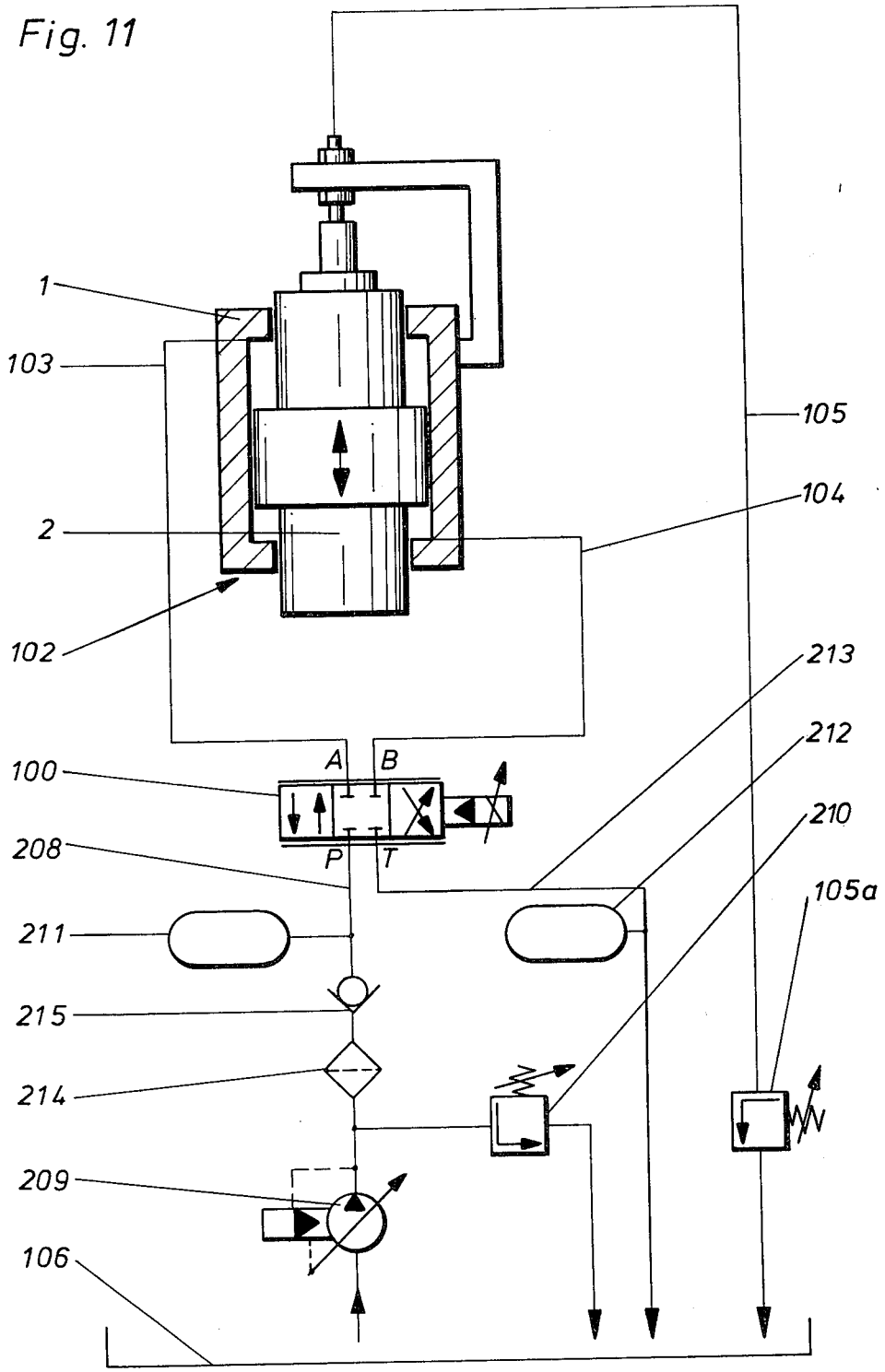
FIG. 11 is a view similar to that of FIG. 1 of an embodiment of a feed system with electro-hydraulic servo valve for the periodical alternating pressurization of the two cyclinder chambers.

FIG. 11 shows a design in which an electrohydraulic servo valve is used for periodic alternate pressurisation of the two cylinder chambers.

The working cylinder 102 shown only schematically in FIG. 11 has a cylinder 1 in which a piston 2 slides in the lengthwise direction. The cylinder 1 is connected by pressure pipes 103 and 104 to the unions A and B of an electro-hydraulic servo valve 100 while a discharge passage 105 for the fluid flushed from the cylinder 1 is connected via an adjustable preloading valve 105*a* to a reservoir tank 106.

The electro-hydraulic servo valve has fed to it a current of fluid under pressure via a pipe 208 and a union P from a pump 209 drawing from the reservoir tank 106, the pump being protected by a pressure limiting valve 210 to maintain the permissible maximum operating pressure.

The pump 209 is a pressure-regulated pump, i.e. the quantity delivered is always available at the electro-hydraulic servo valve 100 at full operating pressure and giving the quantity of fluid under pressure which is required at any particular time.

To the pipe between the union P on the electro-hydraulic servo valve 100 and the pump 209 a hydraulic accumulator 211 is connected, to compensate for fluctuations in volume when an intermittent quantity is drawn off by the electro-hydraulic servo valve 100.

In addition between the union P of the electro-hydraulic servo valve 100 and the pump 209 an extra-fine filter 214 and a non-return valve 215 are provided.

A further union T on the electro-hydraulic servo valve 100 is connected via a return pipe 213 to the reservoir tank 106. A further accumulator 212 is connected to this return pipe 213 to damp out pulsations.

The electro-hydraulic servo valve 100 operates as follows. A particular control current at the input of the electric pilot control stage of the valve corresponds to a particular value of the stroke of the main control plunger in the valve body. This therefore means that with constant pressure drop the flow quantity is proportional to the control current.

Reversal of the control current into the opposite direction causes zero flow through the main control plunger and consequent deflection in the opposite direction. Thus it is possible to direct the flow through the electro-hydraulic servo valve 100 alternately and periodically to the outputs A and B and at the same time the non-pressurised side of the electro-hydraulic servo valve, i.e. either side A or side B and thus pipe 103 or 104 for the corresponding cylinder chamber, is connected to the reservoir tank.

Under the control of the electro-hydraulic servo valve 100 therefore a periodically alternating quantity of fluid under pressure is fed to the two cylinder chambers of the cylinder 1 via the pipes 103 and 104 while the cylinder chamber not supplied with fluid under pressure is connected via the other pipe and the electro-hydraulic control valve 100 with the reservoir tank. In this manner the piston 2 is caused to oscillate in the cylinder 1.

Figure 12:
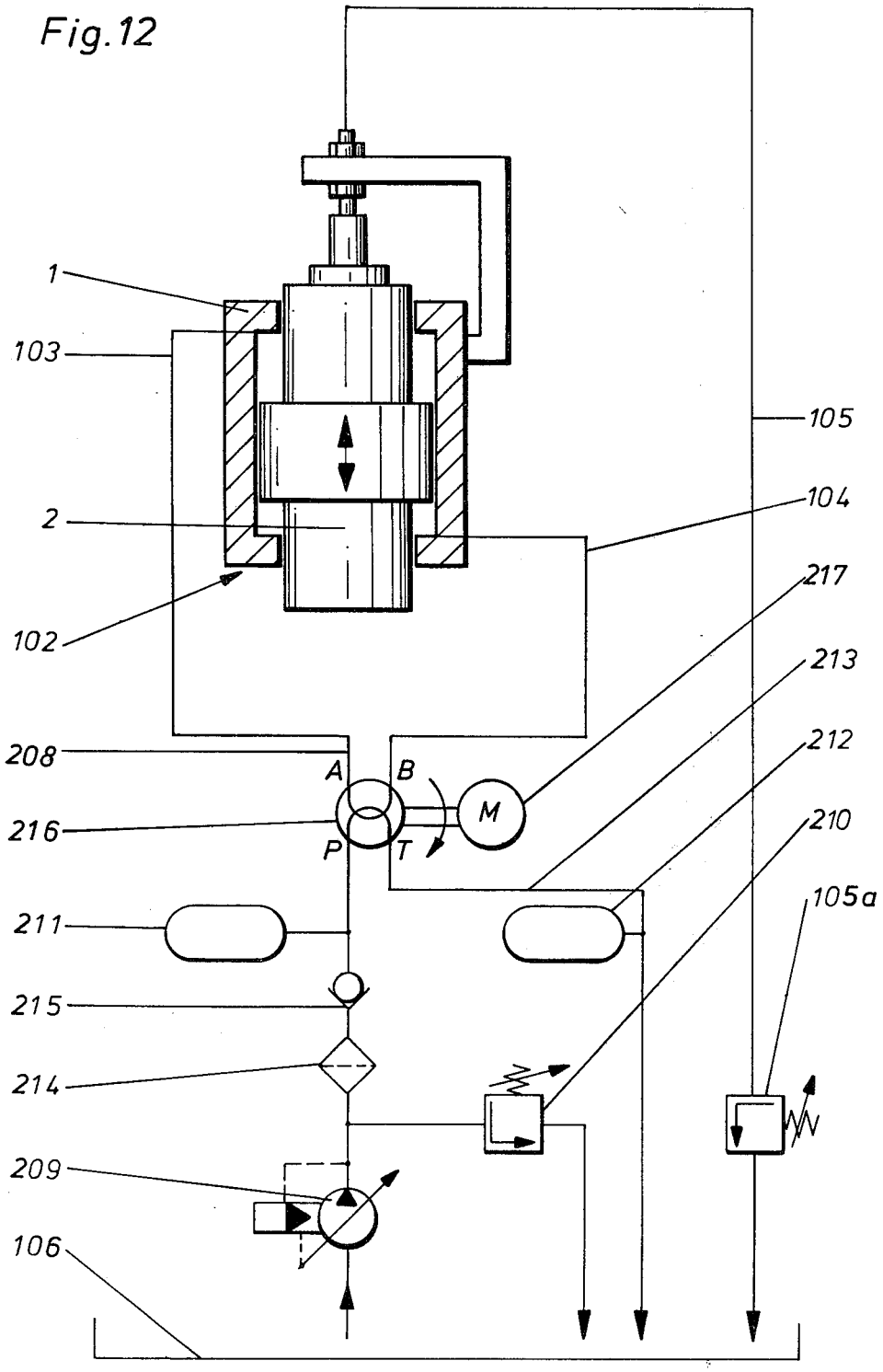
FIG. 12 is a view similar to that of FIG. 11 of an embodiment of a feed system with an impulse generator for the periodic and alternating pressurisation of the cylinder chambers.

In FIG. 12 a design of a hydraulic vibration generator is shown which differs from that in FIG. 11 in that the oscillating movement is caused in a different manner mainly by means of an impulse generator 216 as supplied by the firm SIREX.

The unions A and B of the impulse generator 216 are connected via the pipes 103 and 104 with the cylinder chambers of the cylinder 1 in which the piston 2 is accommodated. A driving motor 217 generates the hydraulic alternating current delivered by the impulse generator, the rotational speed of the electric motor 217 determining the pulse frequency of the vibration generator.

Apart from this the pressure source is of the same construction as with the design in FIG. 11 so that no further description is needed.

With this design the impulse generator 216 has a continuous current of fluid under pressure fed to it via the pipe from the pump 209 and which it transforms into two pulsating currents of fluid under pressure appearing at the unions A and B and which periodically and alternately pressurise the two cylinder chambers while at the same time the non-pressurised cylinder chamber is connected to the reservoir tank 106.

In the designs in accordance with FIGS. 11 and 12 without feedback of the cylinder movement the amplitude of the piston oscillation in relation to the flow characteristic of the control unit, i.e the electro-hydraulic servo valve 100 or the impulse generator 216, is dependent with constant control current, i.e. with constant degree of opening of the control slide, on the pressure drop in the control unit. Thus with a constant mass of cylinder/piston rod the load pressure in the cylinder chambers rises at unions A and B with increasing frequency. With constant pump delivery pressure and constant valve plunger movement, i.e. constant amplitude of the control current, the amplitude of the piston oscillation in the cylinder becomes smaller since the difference between initial pressure at union P minus load pressure at union A and B has decreased.

The initial value of oscillation amplitude of the control unit 100 or 216 thus displays, compared to the input value of control current amplitude, a descending frequency-dependent pattern which in general causes no trouble. Apart from this, this pattern can be compensated by the determination of the characteristics of a particular vibration generator and corresponding setting of the control current.

The linearisation of the amplitude with the frequency is then still a question of scale division of the adjusting members.

This effect can be counteracted in the following manner. The differential pressure at the control unit 100 or 216 is held roughly constant by frequency-dependent matching of the initial pressure at union P at the load pressure pattern determined by means of a frequency-dependent controlled pump pressure adjustment.

Since with this centring equipment described here there is always a certain amount of pressure fluid flushed out, there results at the same time a dissipation of a quantity of heat present in the fluid and thus a cooling effect. This cooling results only as an additional and not absolutely essential auxiliary effect since the control system works as an open circuit, i.e. with each return stroke some of the heated fluid is returned to the reservoir tank.

The principle of the open circuit however does not exactly apply when the swept volume is slight in relation to the volume in the pipes between valve and cylinder, i.e. with small amplitude oscillations of the piston. Then the condition can occur that the quantity of fresh pressurised fluid fed in on the forward stroke fills only part of the pipe and on the return stroke is immediately returned via the union D to the reservoir tank. This operating condition which particularly under long continuous operation can lead to undesirable heating of the pressure fluid and thus of the vibration generator, is surely avoided with the centring equipment with which heat dissipation also occurs at the same time.

We claim:

1. Centering and cooling equipment for a hydraulic vibration generator driven by a pulsation generator the vibration generator including a cylinder containing a movable piston which divides the interior of the cylinder into cylinder chambers at opposite sides of the piston, in which heated pressure fluid is withdrawn from each cylinder chamber and cool pressure fluid fed to it, comprising a feed system operatively connected to said chambers to supply pressure fluid to each said chamber when the pressure therein falls below a predetermined level, and a flushing system operatively connected to said chambers to withdraw a quantity of pressure fluid, dependent on pressure and stroke, from said chambers with each stroke of the piston, wherein said flushing system comprises a control unit composed of a control bush and a control plunger cooperating with said bush.

2. Centering and cooling equipment as claimed in claim 1, wherein said feed system comprises a reservoir tank and two spring-loaded non-return valves each connected between a respective cylinder chamber and said reservoir tank.

3. Centering and cooling equipment as claimed in claim 2, wherein said feed system further comprises a feed pump interposed between said non-return valves and said reservoir tank to deliver fluid at constant pressure, and a pressure-limiting valve connected at a point between said feed pump and said two non-return valves.

4. Centering and cooling equipment as claimed in claim 1, wherein said control unit is accommodated inside the piston.

5. Centering and cooling equipment as claimed in claim 1, wherein said control unit is mounted outside the cylinder.

6. Centering and cooling equipment as claimed in claim 1, wherein said control bush presents channels communicating with said cylinder chambers, said control plunger is provided with tapering portions, and is slidable in said bush for bringing said tapering portions into communication with said channels, and said flushing system further comprises a discharge passage communicating with the regions adjacent said tapering portions.

7. Centering and cooling equipment as claimed in claim 6, wherein each of said channels in said control bush which can be brought into communication with one said tapering portion of said control plunger is in the form of an annular gap.

8. Centering and cooling equipment as claimed in claim 6, wherein said tapering portions are formed by two frusto-conical areas of the outer surface of said control plunger.

9. Centering and cooling equipment as claimed in claim 8, wherein the outer surface of said control plunger is further provided with a groove-like intermediate area extending between, and joining, the frusto-conical areas and said control plunger is provided with at least one radial bore communicating with the outer surface of said plunger in the region of the groove-like area, and a longitudinal bore extending between, and communicating with, said radial bore and said discharge passage.

10. Cooling equipment as claimed in claim 1, wherein said control plunger is solidly fixed to said cylinder and said control bush is coupled to said piston.

11. Centering and cooling equipment as claimed in claim 1, wherein said control plunger is solidly fixed to said piston and said control bush is coupled to said cylinder.

12. Centering and cooling equipment as claimed in claim 1, wherein each of said control plunger and bush is connected to a respective one of the piston and cylinder and further comprising means for adjusting the position of said control plunger relative to that one of the piston and cylinder to which it is connected.

13. Centering and cooling equipment as claimed in claim 12, further comprising means connected for super-imposing an additional movement on said control plunger.

14. Centering and cooling equipment as claimed in claim 1, wherein said flushing system further comprises a discharge passage, the vibration generator is in the form of an angularly-oscillatory motor, with the piston thereof having a hollow shaft defining said control bush, said control plunger is accommodated in said hollow shaft, is formed to define with said shaft an axially-extending slot, and is provided with a radial bore extending between, and communicating with, said slot and said discharge passage, said shaft is provided with radial bores communicating with said cylinder chambers, and said piston and hollow shaft are angularly movable relative to said control plunger for bringing said slot into communication with either one of said radial bores in said shaft.

15. Centering and cooling equipment as claimed in claim 1, wherein said pulsation generator comprises an electro-hydraulic servo valve connected for supplying pressure fluid to the two cylinder chambers periodically and alternately.

16. Centering and cooling equipment as claimed in claim 1, wherein said pulsation generator comprises an impulse generator connected for supplying pressure fluid to the two cylinder chambers periodically and alternately.

* * * * *